US007237537B2

(12) United States Patent
Gokhale et al.

(10) Patent No.: US 7,237,537 B2
(45) Date of Patent: Jul. 3, 2007

(54) COMPRESSION-IGNITION ENGINE CONFIGURATION FOR REDUCING POLLUTANTS AND METHOD AND SYSTEM THEREOF

(75) Inventors: Manoj Prakash Gokhale, Bangalore (IN); Chenna Krishna Rao Boyapati, Bangalore (IN)

(73) Assignee: General Electric Company, Niskayuna, NY (US)

( * ) Notice: Subject to any disclaimer, the term of this patent is extended or adjusted under 35 U.S.C. 154(b) by 179 days.

(21) Appl. No.: 11/096,025

(22) Filed: Mar. 31, 2005

(65) Prior Publication Data

US 2006/0219223 A1 Oct. 5, 2006

(51) Int. Cl.
*F02M 37/04* (2006.01)

(52) U.S. Cl. ..... 123/500

(58) Field of Classification Search ..... 123/500, 123/501, 357

See application file for complete search history.

(56) References Cited

U.S. PATENT DOCUMENTS 3,749,070 A * 7/1973 Oishi et al. ..... 123/406.47
4,412,519 A * 11/1983 Hoch et al. ..... 123/449
4,656,990 A * 4/1987 Miyaki et al. ..... 123/494
4,936,277 A * 6/1990 Deutsch et al. ..... 123/436
5,088,465 A * 2/1992 DeBiasi et al. ..... 123/406.47
5,717,133 A * 2/1998 Wu et al. ..... 73/116
6,144,914 A * 11/2000 Davis et al. ..... 701/104
6,327,856 B1 12/2001 Iwabuchi et al. ..... 60/603
6,357,226 B2 3/2002 Borland ..... 60/298
6,968,830 B2 * 11/2005 Glenn et al. ..... 123/501

FOREIGN PATENT DOCUMENTS

EP 1302651 A1 12/1998

* cited by examiner

*Primary Examiner*—Thomas Moulis
(74) *Attorney, Agent, or Firm*—Fletcher Yoder

(57) ABSTRACT

In accordance with one aspect of the present technique, a method of reducing pollutant emissions from a compression-ignition engine is provided. The method includes adjusting timing of fuel injection into a combustion chamber of a piston-cylinder assembly of the compression-ignition engine. The method of adjusting timing of fuel injection includes indexing a drive mechanism intercoupling a camshaft to a crankshaft by at least one tooth away from a standard position. The method of adjusting timing of fuel injection further includes adjusting a pre-stroke of a plunger of a fuel injector assembly.

22 Claims, 7 Drawing Sheets

COMPRESSION-IGNITION ENGINE CONFIGURATION FOR REDUCING POLLUTANTS AND METHOD AND SYSTEM THEREOF

BACKGROUND

The present invention relates generally to compression-ignition engines and, more particularly to, techniques for reducing undesirable pollutants in emissions from diesel engines.

Compression-ignition engines, such as diesel engines, operate by directly injecting a fuel (e.g., diesel fuel) into compressed air in a combustion chamber of one or more piston-cylinder assemblies, such that the heat of the compressed air lights the fuel-air mixture. Compression-ignition engines in some embodiments include a glow plug to provide heat that ensures ignition in the combustion chamber. The direct fuel injection atomizes the fuel into droplets, which evaporate and mix with the compressed air in the combustion chambers of the piston-cylinder assemblies. Typically, in a turbo-charged diesel engine, air is drawn from the atmosphere and compressed in a compressor. The compressed air is cooled in an intercooler. The compressed and cooled air is then introduced into the combustion chamber. Upon igniting, the fuel-air mixture causes the combustion chamber to expand by moving the piston along the cylinder, thereby producing output power for the particular application. The combustion exhaust gases also power a turbine coupled to the air compressor. A variety of operating parameters affect the engine performance, efficiency, exhaust pollutants, and other engine characteristics. For example, these operating parameters include compression ratio, fuel-air ratio, and fuel injection timing. Exhaust emissions generally include pollutants such as carbon oxides (e.g., carbon monoxide), nitrogen oxides (NOx), sulfur oxides (SOx), hydrocarbons (HC), particulate matter (PM), and so forth.

A variety of techniques may be used to reduce pollutants in the emissions from compression-ignition engines. One technique is to reduce the temperature of the compressed air before introducing it into the combustion chamber. Disadvantageously, this method requires an additional cooling system, which is often expensive to implement. Another technique of reducing the emissions of NOx is to pass the exhaust gases through a NOx catalyst system. Disadvantageously, the NOx catalyst system operates only between certain ranges of temperature and requires additional heating and control systems for effective operation. A further technique involves injecting hydrocarbon into the cylinder of the diesel engine. This technique also requires an additional hydrocarbon injection system and is usually expensive to implement.

Accordingly, a cost effective technique is needed for reducing pollutants in emissions from compression-ignition engines.

BRIEF DESCRIPTION

Briefly in accordance with one aspect of the present technique, a method of reducing pollutant emissions from a compression-ignition engine is provided. The method includes adjusting timing of fuel injection into a combustion chamber of a piston-cylinder assembly of the compression-ignition engine. The method of adjusting timing of fuel injection includes indexing a drive mechanism intercoupling a camshaft to a crankshaft by at least one tooth away from a standard position. The method of adjusting timing of fuel injection further includes adjusting a pre-stroke of a plunger of a fuel injector assembly.

In accordance with one embodiment, the present technique provides a compression-ignition engine configured to reduce pollutant emissions. The compression-ignition engine includes a drive mechanism intercoupling a camshaft and a crankshaft in a configuration retarded by at least one tooth, away from a standard position, wherein the drive mechanism comprises a gear drive, a chain and sprocket drive or a timing belt drive. The piston-cylinder assembly also includes a fuel injector assembly configured to retard the timing of fuel injection into a piston-cylinder assembly of the compression-ignition engine.

DRAWINGS

These and other features, aspects, and advantages of the present invention will become better understood when the following detailed description is read with reference to the accompanying drawings in which like characters represent like parts throughout the drawings, wherein.

Figure 7:
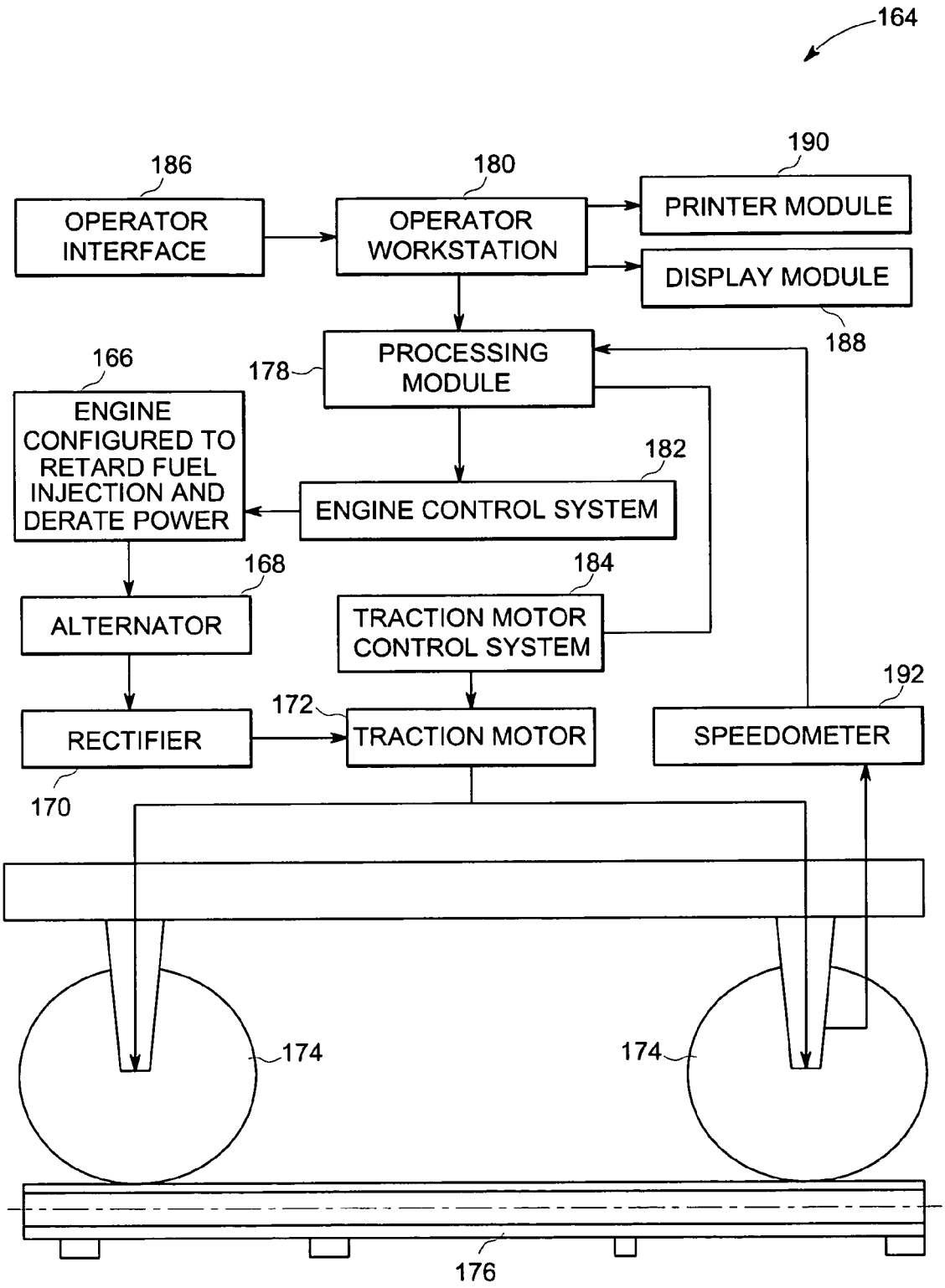
Figure 8:
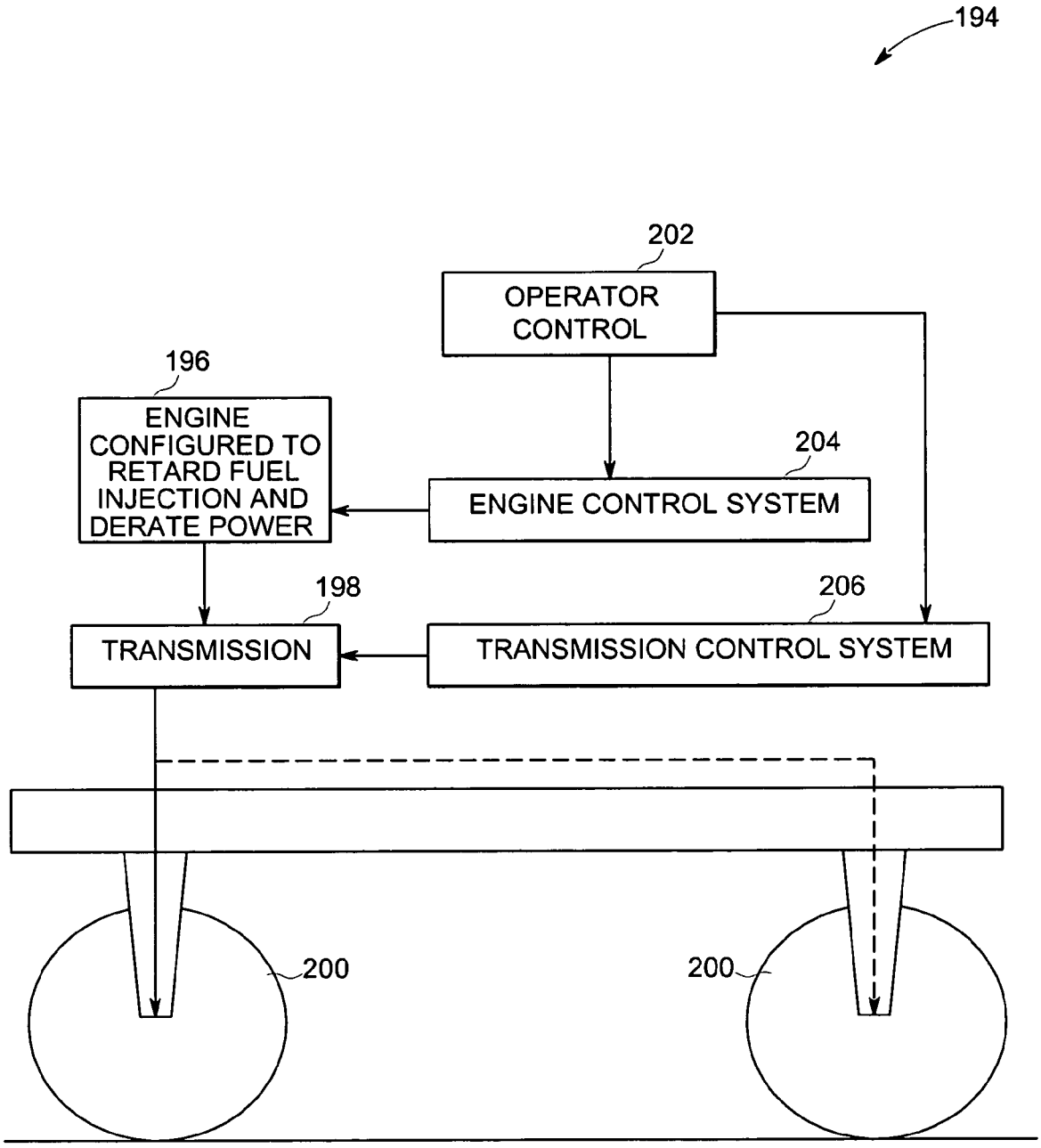

FIG. 7 is a diagrammatic representation of a rail road vehicle having a compression-ignition engine, e.g., a diesel engine, configured to reduce pollutant emissions in accordance with an embodiment of the present technique; and FIG. 8 is a diagrammatic representation of an on road or off-road vehicle having a compression-ignition engine, e.g., a diesel engine, configured to reduce NOx and particulate matter emissions in accordance with an embodiment of the present technique.

DETAILED DESCRIPTION

The present technique is generally directed toward reducing pollutant emissions from compression-ignition engines, such as diesel engines. The applications include automotive vehicles, locomotives, buses, marine transportation (e.g., ships, ferries, submarines, etc.) and stationary applications such as generator sets. As discussed in detail below, embodiments of the present technique retard fuel injection timing by indexing a camshaft by at least one gear tooth (e.g., 4.5 degrees). In addition, certain embodiments involve plunger pre-stroke adjustments of the fuel injector assembly, engine speed adjustments, engine power adjustments, speed adjustments of the turbocharger, or combinations thereof. Together, one or more of these techniques can effectively reduce pollutant emissions to the desired levels.

Figure 1:
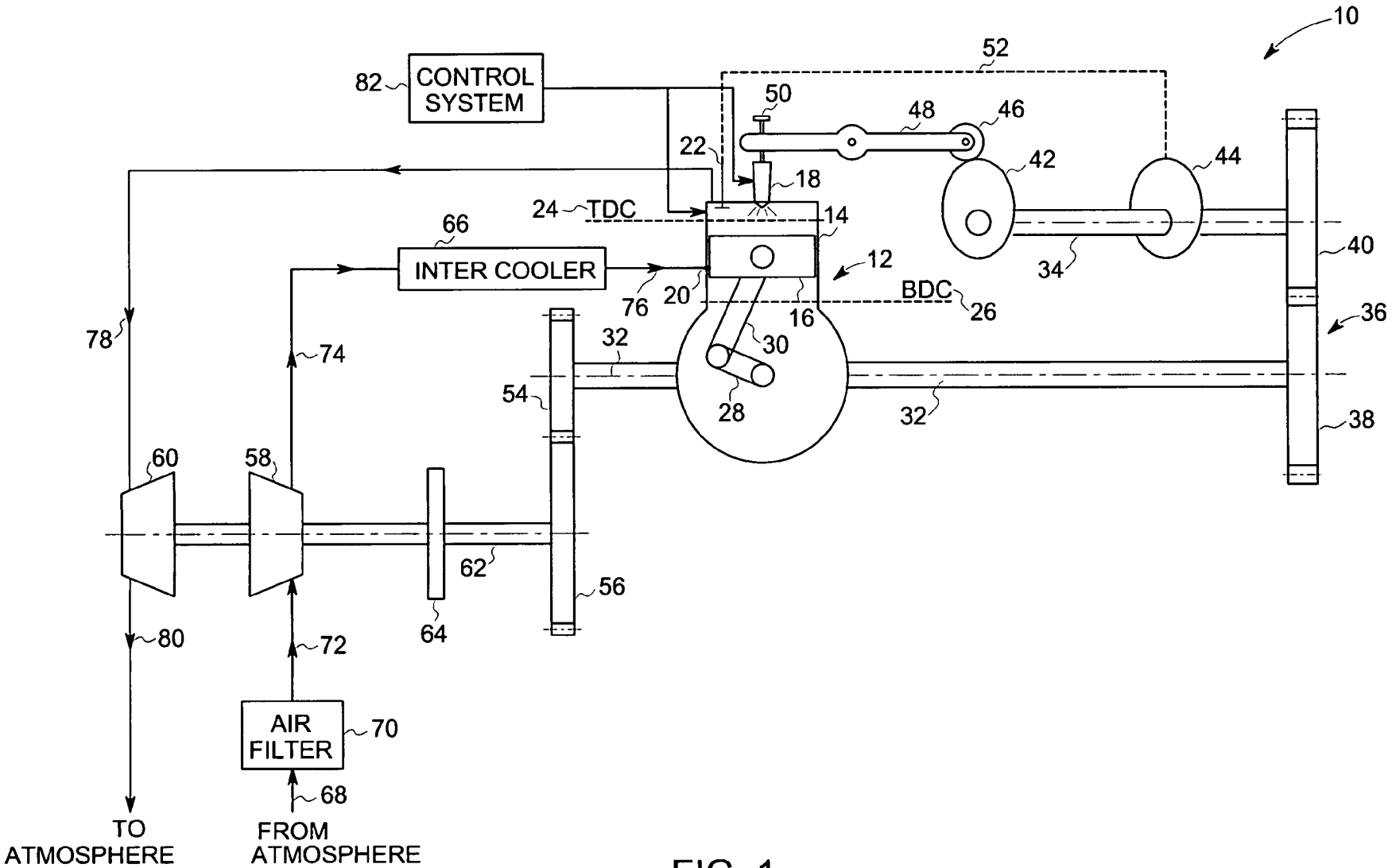
FIG. 1 is a diagrammatic representation of a compression-ignition engine, e.g., a turbo-charged two-stroke diesel engine, having pollutant emissions control features in accordance with an embodiment of the present technique.

Turning now to the drawings, and referring first to FIG. 1, an exemplary embodiment of a compression-ignition engine 10 for use in accordance with the present technique is illustrated diagrammatically. The compression-ignition engine 10 includes a piston-cylinder assembly 12 having one or more cylinders 14, such as two, four, six, eight, ten, or twelve cylinders, each having a piston 16 movably disposed therein. The compression-ignition engine 10 also includes one more fuel injector assembly 18, one or more air intake ports 20, and one or more combustion exhaust ports 22. As appreciated by those skilled in the art, the fuel injector assemblies 18, intake ports 20, and exhaust valves 22 may be disposed within a fuel injection system, an air intake manifold, an exhaust manifold, cylinder heads, or any combination thereof.

Each piston 16 slides inside the respective cylinder 14 in a reciprocating upward and downward motion between a top dead center 24 and a bottom dead center 26, which define the boundaries of the sliding motion of the piston 16. In turn, each piston 16 is coupled to a crank 28 through a connecting rod 30, which facilitates the conversion of the sliding motion of the piston 16 to rotational motion of the crank 28. The crank 28 is an integral part of a crankshaft 32. The crankshaft 32 and a camshaft 34 are coupled by a drive mechanism 36. The drive mechanism 36 may include a gear drive, a timing belt and pulley drive, a chain and sprocket drive, among other suitable drive mechanisms. In the present embodiment, the crankshaft 32 includes a first crank gear 38, which is coupled to a cam gear 40. The rotation of the first crank gear 38 rotates the cam gear 40. The cam gear 40 is coupled to the camshaft 34, which includes a fuel cam 42 and an exhaust valve cam 44 for each piston-cylinder assembly. The fuel cam 42 is coupled to the fuel injector assembly 18 through a cam follower 46, a rocker 48, and a rocker screw 50. The exhaust valve cam 44 is coupled to the exhaust valve 22 through a plurality of links, which may include push rods, rocker, to name but few, as represented by the reference numeral 52. The crankshaft 32 is further coupled to a second crank gear 54. The second crank gear 54 is coupled to a turbo gear 56. The turbo gear 56 is coupled to a compressor 58 and a turbine 60 though a turbo shaft 62. The turbo shaft 62 also includes a clutch 64 to couple the turbo gear 56 to the compressor 58 and the turbine 60. The compression-ignition engine 10 also includes an intercooler 66.

During operation, when the piston 16 moves to the bottom dead center 26, the intake port 20 opens to intake atmospheric air 68 through an air filter 70, the compressor 58, and the intercooler 66. The filtered atmospheric air 72 is compressed by the compressor 58. During compression, the temperature of the air increases. Hence, the compressed air at high temperatures 74 passes through the intercooler 66 and gets cooled to desired temperatures. The compressed and cooled air 76 then enters the piston-cylinder assembly 12 through the intake port 20. As the piston 16 moves towards the top dead center 24, the piston 16 closes the intake port 20. The rotation of the crankshaft closes the exhaust valve 22 through the crank gear 38, cam gear 40, and the exhaust valve cam 44. The piston 16 compresses the air inside the piston-cylinder assembly, which increases the temperature of the air.

As described above, the fuel cam 42 is rotated by the rotation of the crankshaft 32 and the fuel cam 42 actuates the fuel injector assembly 18. Then fuel, such as diesel, is injected into the piston-cylinder assembly 12 through the fuel injector assembly 18. The injected fuel evaporates inside the piston-cylinder assembly 12, mixes with the high temperature air, and ignites. The ignition of the fuel initiates combustion of the fuel-air mixture, which increases the pressure inside the piston-cylinder assembly 12 and forms hot combustion gases. The increase in pressure, as described above, pushes the piston 16 down toward the bottom dead center 26. As the piston approaches the bottom dead center 26, the exhaust valve 22 is opened and as the piston 16 further moves toward the bottom dead center 26, it opens the air intake port 20. Further, as the fresh compressed and cooled air 76 enters the piston-cylinder assembly 12 through the intake port 20, it pushes the combustion gases out through the exhaust port/valve 22. The hot combustion gases 78 then pass through the exhaust valve 22 and the turbine 60. The exhaust gases 80 from the turbine 60 are then exhausted out to the atmosphere.

The exhaust gases, as described above, contain pollutants such as NOx, particulate matter (PM), to name but a few. In order to reduce the emission of pollutants, the fuel injection timing may be adjusted in accordance with embodiments of the present technique. Adjusting the fuel injection timing includes delaying/retarding fuel injection timing by about 3 to 9 degrees from the base line. In some embodiments of the compression-ignition engines, the fuel is injected into the piston-cylinder assembly at about 15 degrees before top dead center 24. In certain embodiments of the present technique, retarding the fuel injection timing is achieved by shifting the intercoupling of the crank gear 38 and the cam gear 40 by at least one tooth. In those embodiments, which utilizes chain and sprocket drive in the drive mechanism, the crankshaft and the camshaft are intercoupled by at least one sprocket tooth away from a standard position. Similarly, the embodiments that utilizes timing belt drive in the drive mechanism, the crankshaft and the camshaft are intercoupled by at least one belt notch away from a standard position. This shifting or indexing results in a shift of about 2 to 6 degrees (e.g., 4.5 degrees) per gear tooth depending on the configuration of the gears 38 and 40. The fuel injection timing may also be delayed by adjusting the fuel injector assembly 18, as described further below. Added to the above, reducing a quantity of fuel injection into the combustion chamber of the piston-cylinder assembly 12 will also reduce the emission of pollutants. The quantity of fuel injected into the piston-cylinder assembly 12 may be reduced by adjusting the fuel injector assembly 18, as described further below. Alternatively, the quantity of fuel injected into the piston-cylinder assembly 12 may be reduced by setting a control parameter in a control system 82. Furthermore, increasing a speed of the compression-ignition engine 10 increases the amount of air 76 and, hence, increases the air-to-fuel ratio. As will be appreciated by those skilled in the art, ignition of the air-fuel mixture having a high air-to-fuel ratio reduces the emission of NOx.

Figure 2:
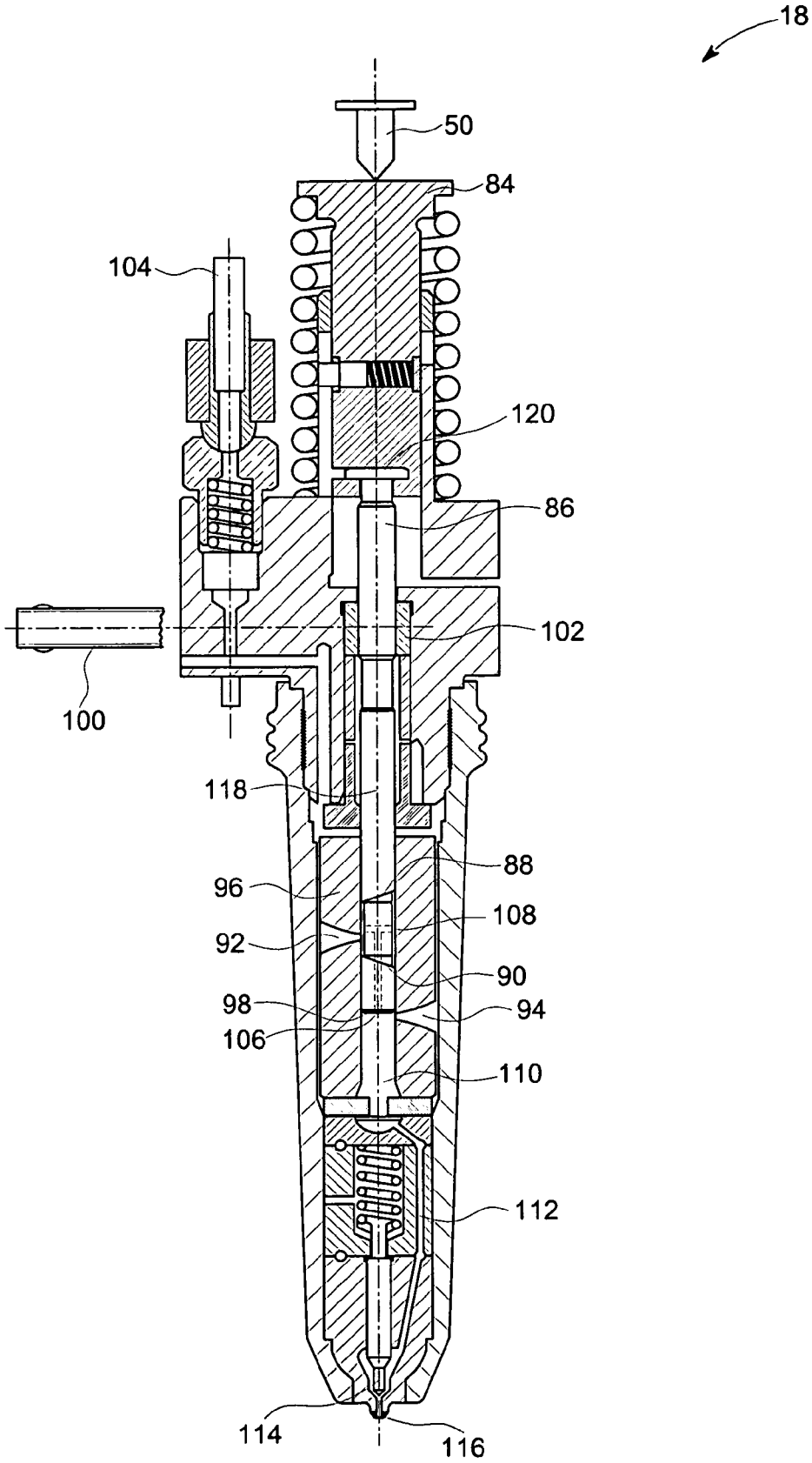
FIG. 2 is a front cross-sectional view of a fuel injector assembly in accordance with an embodiment of the present technique.

FIG. 2 is a front cross-sectional view of a fuel injector assembly 18 of FIG. 1 in accordance with an embodiment of the present technique. As described above, the rocker screw 50 pushes downward on a follower 84 of the fuel injector assembly 18. The follower 84 is coupled to a plunger 86, which has an upper helix 88 and a lower helix 90. The helixes 88 and 90 control the opening and closing of the fuel ports 92 and 94, as described further below. The plunger 86 slides through a barrel 96, which has the two fuel ports 92 and 94. The fuel ports 92 and 94 facilitate the flow of fuel into the barrel 96. The plunger 86 also has a bottom end 98. The fuel injector assembly 18 further includes a rack 100 and a pinion 102. The pinion 102 is slidably coupled to the plunger 86. The fuel, e.g., diesel fuel, flows through a fuel line 104 toward the top port 92 and the bottom port 94 of the barrel 96. The plunger 86 has a hole 106 at the center of the bottom end 98. The plunger 86 has another hole 108 near the bottom end 98 between the top helix 88 and the bottom helix 90. The holes 106 and 108 are interconnected.

During operation, the rocker screw 50 activates the follower 84, which pushes the plunger 86 downward from its top position until the bottom end 98 closes the port 94. As the plunger moves further down, the top helix 90 closes the top port 92. The stroke of the plunger from its top position until both of the ports 92 and 94 are closed is generally referred to as plunger pre-stroke. The pre-stroke facilitates increasing the speed of the plunger before pressurizing the fuel. As a result of the plunger pre-stroke, the fuel is trapped inside a space 110 and hence is pressurized as the plunger 86 moves further down. The pressurized fuel passes through a passage 112 and pressuringly lifts the needle 114, thereby opening the injector hole 116 to start fuel injection. In other words, the plunger pre-stroke captures an amount of fuel, which is subsequently injected into the piston-cylinder assembly a relatively short time thereafter. In certain embodiments, by adjusting the plunger pre-stroke, the timing of the fuel injection is adjusted to reduce pollutant emissions. As the plunger 86 further moves down, the bottom helix 90 opens the top port 92 and the fuel in the space 110 is escapes through the holes 106 and 108 to the top port 92. Hence, the pressure of fuel in space 110 and the passage 112 drops, thereby closing the needle 114 and ending the fuel injection. The plunger 86 can be rotated about a central axis 118 by the rack 100 and pinion 102. The rotation of the plunger 86 changes the angular position of the top helix 88 and the bottom helix 90 with respect to the central axis 118. The change in the helix position, as described above, changes the start and end of fuel injection and hence changes the quantity of fuel injection.

As will be appreciated by those skilled in the art, the pre-stroke of the plunger 86 may be increased to retard the fuel injection timing by various different methods. One method of increasing the pre-stroke of the plunger is to adjust the rocker screw to change the plunger pre-stroke. The other method of increasing the pre-stroke of the plunger is to change the follower to change the plunger pre-stroke. Another method of increasing the pre-stroke of the plunger is to change the position of the helix in the plunger. Yet another method is to select a plunger having a length shorter than the standard plunger between a top end 120 of the plunger 86 and the top helix 88. Similarly, the plunger 86 may be rotated through the rack 100 and pinion 102 to change the position of the helixes 88 and 90 and hence to change the quantity of fuel injection.

Figure 3:
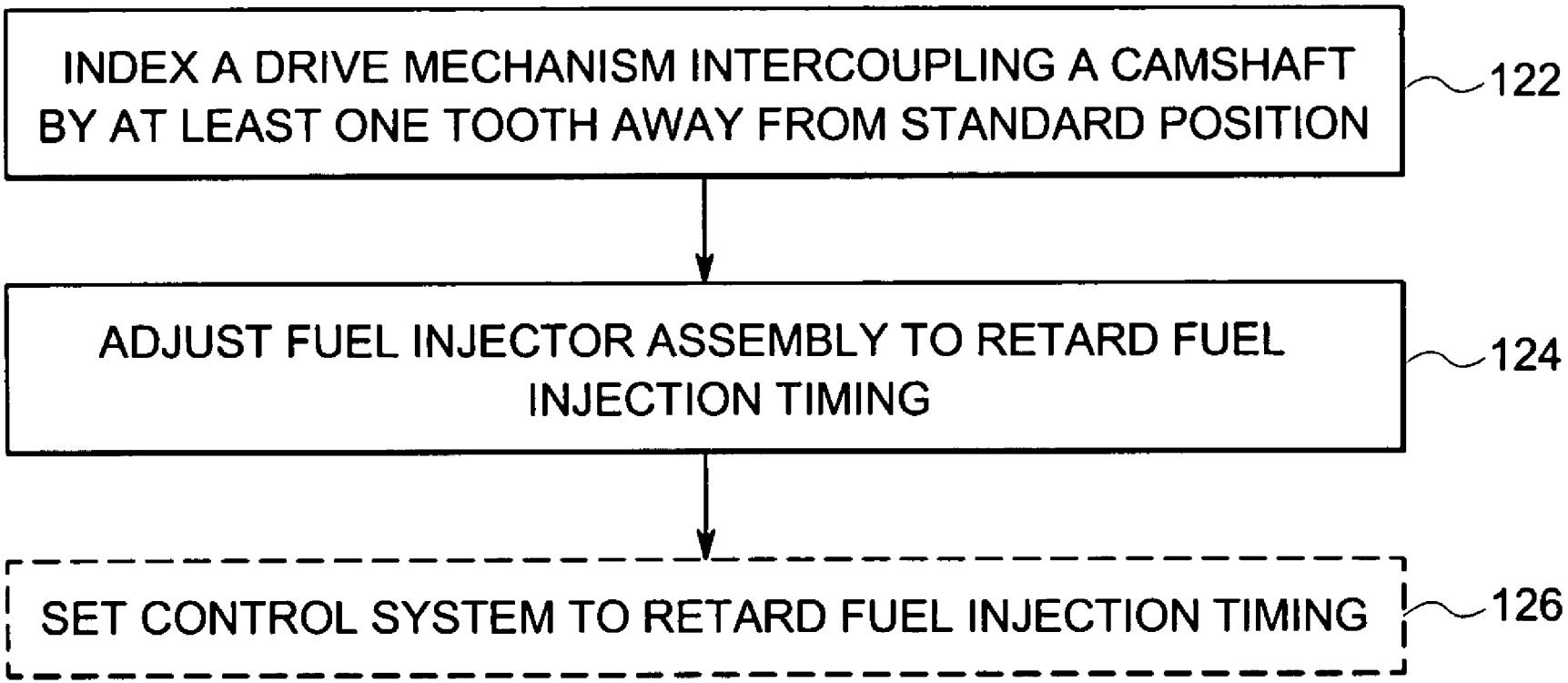
FIG. 3 is a flowchart illustrating an exemplary method of retarding fuel injection timing in a compression-ignition engine, e.g., a diesel engine, to reduce pollutant emissions in accordance with embodiments of the present technique.

FIG. 3 is a flowchart illustrating an exemplary method of retarding fuel injection timing in a compression-ignition engine in accordance with aspects of present technique. As will be appreciated by those skilled in the art, retarding the fuel injection timing reduces the pollutant emissions in compression-ignition engines. The method includes indexing the drive mechanism intercoupling the crankshaft and the camshaft with a shift or offset of at least one tooth from standard position to retard the fuel injection timing by about 3 to 9 degrees from the base line, as in step 122. The method also includes adjusting the fuel injector assembly to retard fuel injection timing, as in step 124. As describe above, the adjustment of the fuel injector assembly includes modifying a length of the plunger between the top of the plunger and the top helix, modifying the follower, adjusting a helix position in the plunger, or by adjusting the rocker screw, or a combination of adjustments. The method further includes setting up the control parameter such as rack position in the control system to retard the fuel injection timing, as in step 126. As described above, the rack and pinion may be utilized to change the helix position, which may reduce the length of the plunger between its top end and the top helix to retard fuel injection timing, in addition to changing the quantity of fuel injection into the piston-cylinder assembly.

Figure 4:
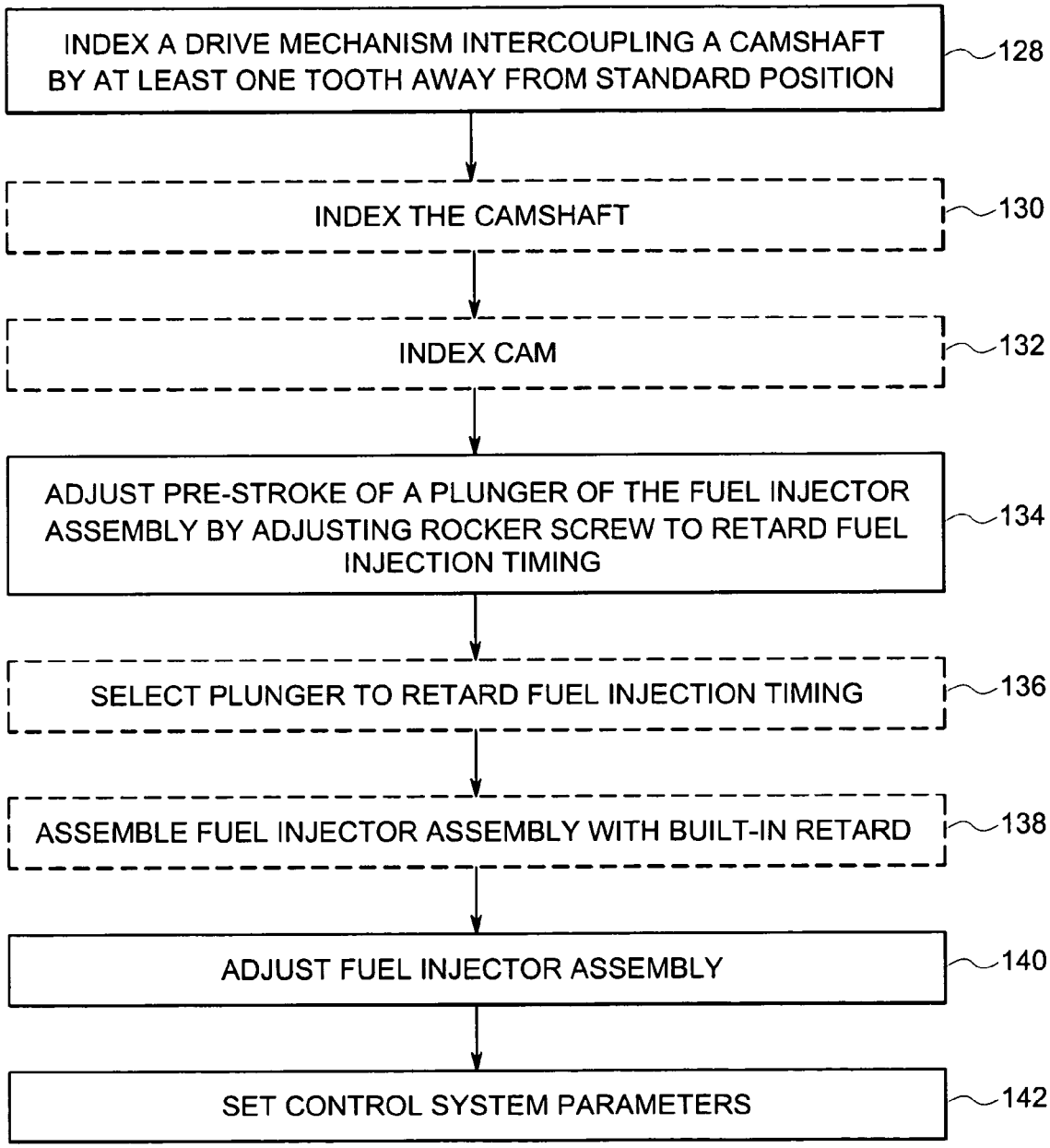
FIG. 4 is a flowchart illustrating an exemplary method of manufacturing a compression-ignition engine, e.g., a diesel engine, configured with fuel injection timing retard and with de-rated power output to reduce pollutant emissions in accordance with embodiments of the present technique.

FIG. 4 is a flowchart illustrating an exemplary method of manufacturing and/or configuring a compression-ignition engine with fuel injection timing retard and with de-rated power output in accordance with aspects of present technique. The method includes indexing the drive mechanism intercoupling the crankshaft and the camshaft with a shift or offset of at least one tooth from standard position to retard the fuel injection timing by about 3 to 9 degrees from the base line, as in step 128. Alternatively, the camshaft may be indexed with respect to the cam gear to retard the fuel injection timing by about 3 to 9 degrees from the base line, as in step 130. Similarly, the fuel cam 42 may also be indexed with respect to the camshaft or cam gear to retard the fuel injection timing by about 3 to 9 degrees from the base line, as in step 132. The method further includes adjusting the pre-stroke of the plunger of the fuel injector assembly by adjusting the rocker screw of the fuel injector assembly to retard fuel injection timing as in step 134. As described above, the pre-stroke of the plunger may be modified by modifying a length of the plunger between the top of the plunger and the top helix, modifying the follower, adjusting a helix position in the plunger, or by adjusting the rocker screw, or a combination of adjustments. The method also includes selecting a plunger having a length shorter than the standard plunger between the top end 120 of the plunger and the top helix 88 to retard fuel injection timing, as in step 136. Alternatively, a fuel injector assembly with built-in retard, i.e. a fuel injector assembly with a plunger having a length shorter than the standard plunger between the top end 120 of the plunger and the top helix 88 may also be utilized to retard fuel injection timing as in step 138. The method also includes adjusting the fuel injector assembly to retard the fuel injection timing and derating the power output of the compression-ignition engine by at least by five percentage, as in step 140. The method includes adjusting the pre-stroke of the plunger, as describe above to retard the fuel injection timing. The method further includes adjusting the helix position in the plunger through the rack and pinion to derate the output of the compression-ignition engine. The method further includes setting up one or more control parameters, such as speed of the compression-ignition engine, rack and pinion settings to adjust quantity for fuel injection in the control system to retard the fuel injection timing and derate the power output of the compression-ignition engine, as in step 142.

Figure 5:
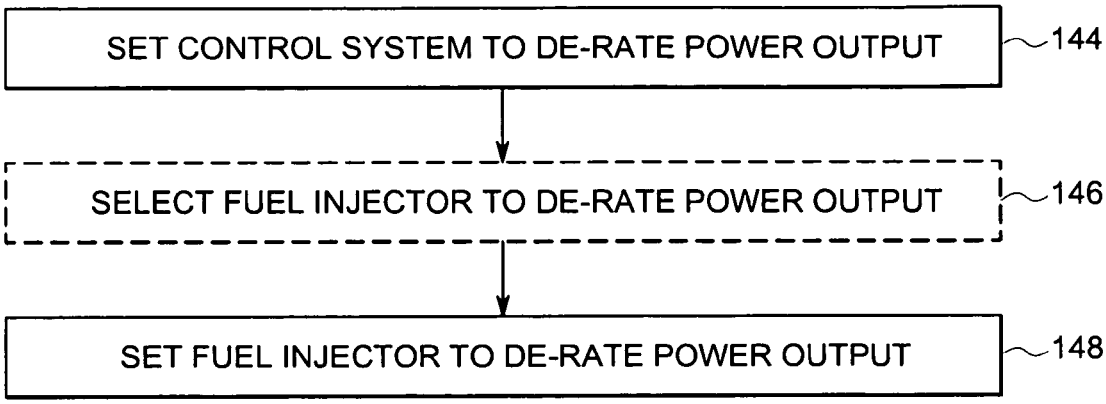
FIG. 5 is a flowchart illustrating an exemplary method of de-rating power output of a compression-ignition engine, e.g., a diesel engine, to reduce pollutant emissions in accordance with embodiments of the present technique.

FIG. 5 is a flowchart illustrating an exemplary method of de-rating power output of a compression-ignition in accordance with aspects of the present technique. The method includes setting up one or more control parameters, such as rack and pinion settings in the control system to derate power output at full load conditions by a desired percentage (e.g., at least five percent) by reducing the amount of fuel injection as in step 144. Alternatively, a fuel injector assembly having the helixes position configured to reduce fuel injection, as described above may also be utilized to derate the power output of the compression-ignition engine as in step 146. The method also includes adjusting the helix position in the plunger through the rack and pinion system in fuel injector assembly to reduce fuel injection into the piston-cylinder assembly as in step 148.

Figure 6:
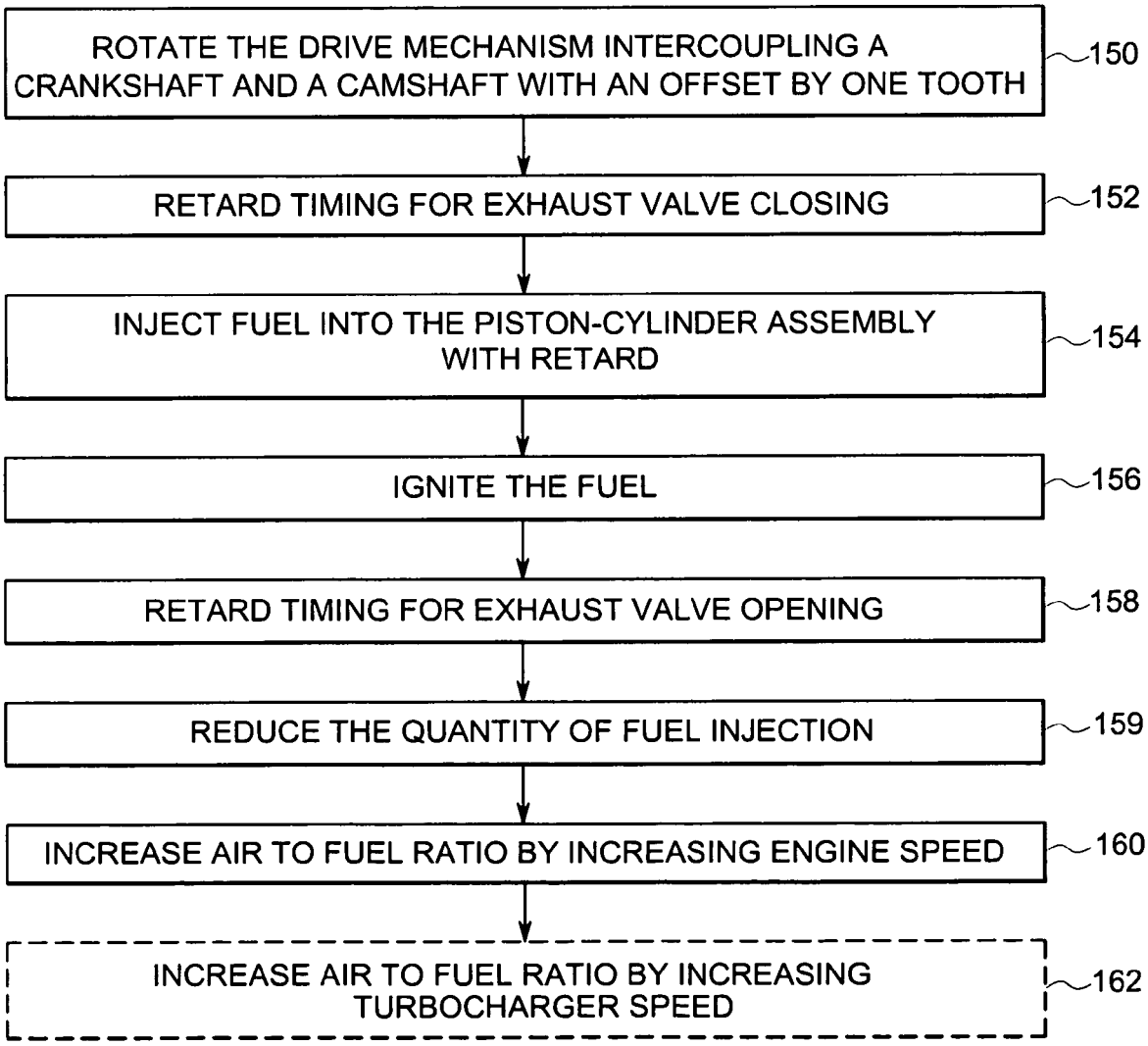
FIG. 6 is a flowchart illustrating a method of operation of a compression-ignition engine, e.g., a diesel engine, to reduce pollutant emissions in accordance with aspects of present technique.

FIG. 6 is a flowchart illustrating a method of operation of a compression-ignition engine, such as a diesel engine, in accordance with aspects of present technique. The method includes rotating the drive mechanism intercoupling the crankshaft and the camshaft by an offset of at least one tooth, as in step 150. The method further includes retarding the exhaust valve closing, as in step 152. The camshaft is inter-coupled with the crankshaft as described above to retard the fuel injection timing. Since the cam that activates the exhaust valve is also coupled to the same camshaft, the exhaust valve closing is also retarded. The method includes injecting fuel into the piston-cylinder assembly with a delay of about 3 to 9 degrees from the base line to reduce the pollutant emissions, particularly NOx, as in step 154. The injected fuel mixes with hot compressed air inside the piston-cylinder and gets ignited, as in step 156. The method includes retarding the exhaust valve opening, as in step 158. The method also includes reducing a quantity of fuel injection into the piston-cylinder assembly to derate the power output of the compression-ignition engine by at least five percentage at full load conditions, as in step 159. As described above, since the cam that activates the exhaust valve is coupled to the camshaft, which is intercoupled to the crankshaft with a shift, the exhaust valve opening is also retarded. The air-to-fuel ratio may be increased by increasing the speed of the compression-ignition engine, as in step 160. Alternatively, the air-to fuel ratio may also be increased by increasing the speed of the turbocharger, as in step 162.

FIG. 7 is a diagrammatic representation of a railroad vehicle 164 having a compression-ignition engine configured to reduce pollutant emissions in accordance with an embodiment of the present technique. The railroad vehicle 164 includes an engine 166 having an indexed camshaft (e.g., retarded by at least one gear tooth) and a fuel injector assembly configured for retarding fuel injection timing and for derating the power output by reducing the quantity of fuel injection. The engine 166 is coupled to an alternator 168, which converts mechanical energy to electrical energy. The alternator 168 is coupled to a rectifier 170 to convert an alternating current (AC) to direct current (DC). The DC from the rectifier 170 is utilized to activate a traction motor 172. The traction motor 172 is coupled to the wheels 174 to move the railroad vehicle 164 over the rail 176. The railroad vehicle 164 further includes a processing module 178, which processes information between an operator workstation 180, an engine control system 182, and a traction motor control system 184. The engine control system 182 controls various parameters, such as fuel injection timing, quantity of fuel injection, engine speed, turbocharger speed to name but few parameters. The traction motor control system 184 controls the operations of the traction motor 172. An operator can interact with the operator workstation 180 via operator interface 186. The operator workstation 180 is further connected to a display module 188 and/or a printer module 190. The railroad vehicle 164 also includes a speedometer 192, which monitors the speed to the railroad vehicle 164 and transmits the data to the processing module 178. The railroad vehicle 164 may also increase the air-to-fuel ratio by increasing the engine speed or by increasing the turbocharger speed to reduce the pollutant emissions. Thus, the locomotive having the compression-ignition engine, as described above, reduces the pollutant emissions by retarding the fuel injection timing, derating the power out put of the compression-ignition engine and/or increasing the air-to fuel ratio.

FIG. 8 is a diagrammatic representation of a vehicle 194 having a compression-ignition engine, such as a diesel engine, configured to reduce NOx and particulate matter emissions in accordance with an embodiment of the present technique. The vehicle 194 includes an engine 196 having an indexed camshaft (e.g., retarded by at least one gear tooth) and a fuel injector assembly configured for retarding fuel injection timing and for derating the power output by at least five percentage at full load conditions. The engine 196 is coupled to a transmission system 198, such as an automatic or manual transmission having a drive shaft. The transmission system 198 is coupled to the wheels 200 to move the vehicle 194. An operator control 202 is coupled to an engine control system 204 to control the operations of the engine 196. Similarly, the operator control 202 is coupled to the transmission control system 206 to control the transmission system 198. As described above, the vehicle 194 may also increase the air-to-fuel ratio by increasing the engine speed or by increasing the turbocharger speed to reduce the pollutant emissions. The compression-ignition engine as described above reduces the pollutant emissions and may be utilized in cars, buses, trucks, ships etc., to name but few applications.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of reducing pollutant emissions from a compression-ignition engine, the method comprising:

adjusting timing of fuel injection into a combustion chamber of a piston-cylinder assembly of the compression-ignition engine, comprising:

indexing a drive mechanism intercoupling a camshaft to a crankshaft by at least one tooth away from a standard position; and adjusting a pre-stroke of a plunger of a fuel injector assembly.

2. The method of claim 1, wherein adjusting timing of fuel injection comprises retarding the timing of fuel injection in a range of about 3 to 9 degrees from a baseline.

3. The method of claim 1, wherein indexing the drive mechanism comprises shifting a cam gear of the drive mechanism coupled to the camshaft relative to a crank gear of the drive mechanism coupled to the crankshaft.

4. The method of claim 1, wherein adjusting the pre-stroke of the plunger of the fuel injector assembly comprises modifying the plunger length, modifying a length of a follower, adjusting a helix position in the plunger, or adjusting a rocker screw position, or any combination thereof.

5. The method of claim 1, comprising de-rating power output from the compression-ignition engine at least by five percentage at full load condition by reducing a quantity of fuel injection into the piston-cylinder assembly.

6. The method of claim 5, wherein derating power output comprises setting a control parameter in a control system to reduce a quantity of fuel injection into the piston-cylinder assembly of the compression-ignition engine.

7. The method of claim 1, comprising setting a control parameter in a control system to increase an air-to-fuel ratio by increasing a speed of the compression-ignition engine or a speed of a turbocharger.

8. A method of operating a compression-ignition engine, the method comprising:

rotating a crankshaft in response to movement of a piston forced to move by combustion in a chamber of a piston-cylinder assembly of the compression-ignition engine;

rotating first and second drive elements of a drive mechanism intercoupling the crankshaft to a camshaft, wherein the first and second drive elements are offset by at least one tooth relative to a standard configuration; and moving an exhaust valve in response to movement of the camshaft, wherein movement of the exhaust valve is shifted based on the offset of the first and second drive elements.

9. The method of claim 8, wherein moving the exhaust valve comprises retarding the exhaust valve opening to increase an expansion of combustion gases in an exhaust stroke.

10. The method of claim 9, wherein retarding the exhaust valve opening reduces a time for discharging the combustion gases into the atmosphere.

11. The method of claim 8, further comprising de-rating power output of the compression-ignition engine at full load condition, wherein de-rating the power output comprises reducing a quantity of fuel injection into the piston-cylinder assembly to reduce pollutant emissions.

12. The method of claim 8, further comprising increasing an air-to-fuel ratio, wherein increasing the air-to-fuel ratio comprises increasing a speed of the compression-ignition engine, increasing a speed of a turbo charger or a combination thereof, to reduce pollutant emissions.

13. A compression-ignition engine configured to reduce pollutant emissions, comprising:

a drive mechanism intercoupling a camshaft and a crankshaft in a configuration retarded by at least one tooth, away from a standard position, wherein the drive mechanism comprises a gear drive, a chain and sprocket drive or a timing belt drive; and a fuel injector assembly configured to retard the timing of fuel injection into a piston-cylinder assembly of the compression-ignition engine.

14. The compression-ignition engine of claim 13, wherein the fuel injector assembly comprises a plunger configured to retard the timing of fuel injection into a piston-cylinder assembly of the compression-ignition engine by adjusting a pre-stroke of the plunger.

15. The compression-ignition engine of claim 13, wherein the fuel injector assembly is coupled to the camshaft, wherein the fuel injector assembly is configured to reduce a quantity of fuel injection into the piston-cylinder assembly to de-rate power output of the compression-ignition engine at full load condition.

16. The compression-ignition engine of claim 13, further comprising a control system configured to reduce a quantity of fuel injection into the piston-cylinder assembly to de-rate power output of the compression-ignition engine at full load condition.

17. A vehicle, comprising:

a compression-ignition engine, comprising:

a camshaft having a cam gear, wherein the cam gear is coupled to a crank gear and the cam gear is indexed relative to the crank gear by at least one tooth away from a standard position to retard a timing of fuel injection into a piston-cylinder assembly of the compression-ignition engine.

18. The vehicle of claim 17, comprising a fuel injector assembly coupled to the camshaft, wherein the fuel injector assembly is configured to reduce a quantity of fuel injection into the piston-cylinder assembly of the compression-ignition engine to de-rate power output of the compression-ignition engine at full load condition.

19. The vehicle of claim 17, comprising a control system configured to reduce a quantity of fuel injection into the piston-cylinder assembly of the compression-ignition engine to de-rate power output of the compression-ignition engine at full load condition.

20. The vehicle of claim 17, wherein the vehicle is a locomotive.

21. The vehicle of claim 17, wherein the vehicle is a ship.

22. The vehicle of claim 17, wherein the vehicle is an automobile.

* * * * *